US011098538B2

(12) United States Patent
Wisinger, Jr. et al.

(10) Patent No.: US 11,098,538 B2
(45) Date of Patent: Aug. 24, 2021

(54) FLOW THROUGH WIRELINE TOOL CARRIER

(71) Applicant: Halliburton Energy Services, Inc., Houston, TX (US)

(72) Inventors: John Leslie Wisinger, Jr., Spring, TX (US); Jonathan Peter Zacharko, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 204 days.

(21) Appl. No.: 16/308,958

(22) PCT Filed: Jul. 15, 2016

(86) PCT No.: PCT/US2016/042642
§ 371 (c)(1),
(2) Date: Dec. 11, 2018

(87) PCT Pub. No.: WO2018/013143
PCT Pub. Date: Jan. 18, 2018

(65) Prior Publication Data

US 2019/0316425 A1 Oct. 17, 2019

(51) Int. Cl.
*E21B 17/10* (2006.01)
*E21B 47/01* (2012.01)
(Continued)

(52) U.S. Cl.
CPC ..... *E21B 17/1078* (2013.01); *E21B 17/023* (2013.01); *E21B 19/22* (2013.01);
(Continued)

(58) Field of Classification Search
CPC .... E21B 17/1078; E21B 17/023; E21B 23/00; E21B 19/22; E21B 47/01
See application file for complete search history.

(56) References Cited

U.S. PATENT DOCUMENTS 3,285,629 A 11/1966 Cullen
5,429,194 A 7/1995 Nice
(Continued)

FOREIGN PATENT DOCUMENTS

WO WO9705361 2/1997

OTHER PUBLICATIONS

Schlumberger Oilfield Glossary entry for "wireline", accessed Sep. 29, 2020 via www.glossary.oilfield.slb.com.*
(Continued)

*Primary Examiner* — Blake E Michener
(74) *Attorney, Agent, or Firm* — Haynes and Boone, LLP

(57) ABSTRACT

A carrier system may be used to position a wireline tool within a wellbore. The system includes a wireline tool carrier disposed on the end of a coiled tubing string. The wireline carrier tool includes a tubular member and stabilizers which secure the wireline tool within an internal passageway of the tubular member. The internal passageway defines a fluid flow path which facilitates fluid communication between the coiled tubing string and any device or wellbore portion below the wireline tool carrier. As the system is advanced within the wellbore fluid is conveyed around the wireline tool through the fluid flow path to remove obstructions that would otherwise inhibit the placement of the wireline tool within a deviated wellbore. Fluid conveyed through the system and around the wireline tool may also be used to perform various well stimulation and intervention functions.

14 Claims, 4 Drawing Sheets

(51) Int. Cl.

| | |
|---|---|
| ***E21B 17/02*** | (2006.01) |
| ***E21B 23/00*** | (2006.01) |
| ***E21B 19/22*** | (2006.01) |
| *E21B 37/00* | (2006.01) |

(52) U.S. Cl.
CPC ..... *E21B 23/00* (2013.01); *E21B 47/01* (2013.01); *E21B 37/00* (2013.01)

(56) References Cited

U.S. PATENT DOCUMENTS

| | | | | |
|---|---|---|---|---|
| 5,435,395 | A | 7/1995 | Connell | |
| 6,009,216 | A * | 12/1999 | Pruett | G01V 11/002 385/12 |
| 8,020,634 | B2 * | 9/2011 | Utter | E21B 17/07 175/57 |
| 2002/0074135 | A1 | 6/2002 | Headworth | |
| 2008/0066920 | A1 | 3/2008 | Allcorn et al. | |
| 2008/0066961 | A1 | 3/2008 | Aivalis et al. | |
| 2012/0211231 | A1 | 8/2012 | Erkol et al. | |
| 2015/0267481 | A1 * | 9/2015 | Logan | E21B 47/017 175/40 |

OTHER PUBLICATIONS

International Search Report and the Written Opinion of the International Search Authority, or the Declaration, dated Apr. 14, 2017, PCT/US2016/042642, 18 pages, ISA/KR.
Office Action issued by the Canadian Intellectual Property Office dated Oct. 21, 2019 for Application No. 3,026,846; 5 pages.

* cited by examiner

FLOW THROUGH WIRELINE TOOL CARRIER

PRIORITY

The present application is a U.S. National Stage patent application of International Patent Application No. PCT/US2016/042642, filed on Jul. 15, 2016, the benefit of which is claimed and the disclosure of which is incorporated herein by reference in its entirety.

BACKGROUND

The present disclosure generally relates to oilfield equipment and, in particular, to downhole tools, systems and techniques for coiled tubing operations in a wellbore. More particularly, the disclosure relates to using coiled tubing to convey a wireline tool within a wellbore while flowing fluid around the wireline tool.

Coiled tubing generally refers to relatively flexible, continuous tubing that can be run into the wellbore from a large spool mounted on a truck or other support structure. Coiled tubing may be used in a variety of wellbore operations including drilling, completion, stimulation, workovers, and other procedures. Coiled tubing may be used, for example, to inject gas or other fluids into the wellbore, to inflate or activate and packers, to transport logging tools, and/or to perform remedial cementing and clean-out operations in the wellbore.

The semi-rigid, lightweight nature of coiled tubing makes it particularly useful in deviated wellbores. For example, the stiffness of coiled tubing may permit operators to advance a slickline tool or wireline tool in high angle or horizontal wells more effectively than on wirelines or slicklines, which typically depend on gravity to move downhole.

Prior to positioning the wireline tool in the deviated wellbore, it is often necessary to remove obstructions that would otherwise impede the positioning of the wireline tool. To accomplish this, a first run is made using a cleaning tool at the end of the coiled tubing string. Fluid may be pumped through the coiled tubing and the cleaning tool to break up and remove the obstructions. After this initial run is completed, the cleaning tool is removed from the wellbore, and the wireline tool is deployed in a second run downhole.

DESCRIPTION OF ILLUSTRATIVE EMBODIMENTS

In the following description, even though a figure may depict an apparatus in a horizontal portion or a vertical portion of a wellbore, unless indicated otherwise, it should be understood by those skilled in the art that the apparatus according to the present disclosure is equally well-suited for use in wellbores having other orientations including, deviated wellbores, multilateral wellbores, or the like. Likewise, unless otherwise noted, even though a figure may depict an onshore operation, it should be understood by those skilled in the art that the apparatus according to the present disclosure is equally well-suited for use in offshore operations and vice-versa.

As described herein, illustrative embodiments of the present disclosure are directed to a system and method for flowing fluid past a wireline tool that is carried by a coiled tubing string within a wellbore. In a generalized embodiment, a tool carrier includes a connector for coupling an elongate tubular member to the downhole end of the coiled tubing string. Disposed within the elongate tubular member are a fixed stabilizer and a floating stabilizer, which receive the wireline tool so as to define a flow path between the wireline tool and the elongate tubular member. Fluid may be conveyed through the coiled tubing string and past the wireline tool through the flow path. In some embodiments, the fluid may pass around the wireline tool and into a cleaning tool carried below the tool carrier. The fluid may then be used to remove debris which would inhibit the positioning of the wireline tool within the wellbore as making multiple runs with coiled tubing to position wireline tools in the wellbore may be expensive and time consuming. Alternatively, the fluid may be used to stimulate the wellbore or formation or actuate a tool disposed within the wellbore.

Figure 1:
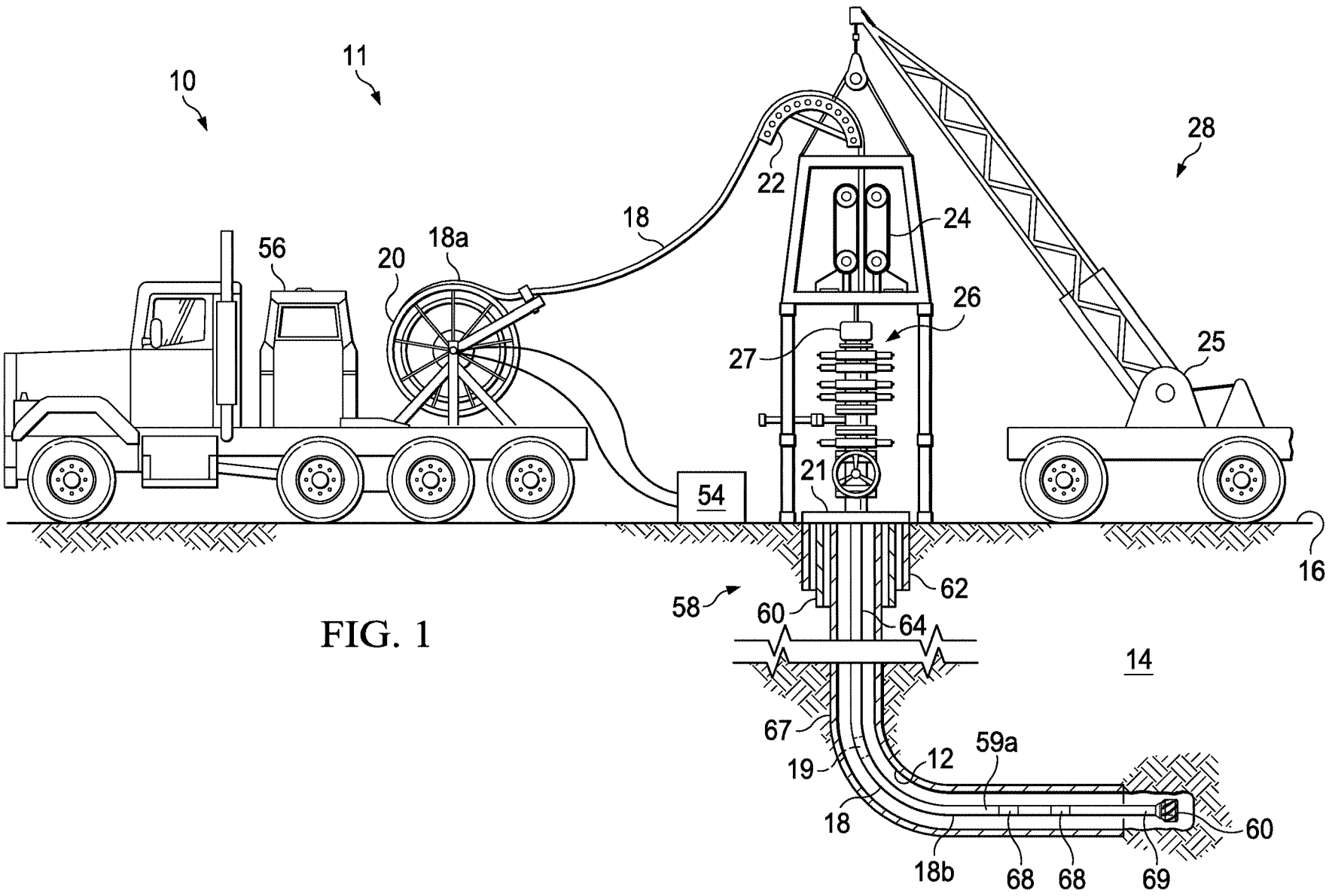
FIG. 1 is an elevation view in partial cross section of a land-based coiled tubing well system with a wireline tool carrier deployed in a deviated wellbore.

FIG. 1 is an elevation view in partial cross-section of a well system 10 having a coiled tubing system 11 for retrievably deploying coiled tubing 18 in a well operation. In the present example, the well operation includes a drilling operation to drill a wellbore 12 through various earth strata in a geologic formation 14 located below the earth's surface 16. Although a land-based coiled tubing system 11 is depicted in FIG. 1, a coiled tubing string can be deployed from floating rigs, jackups, platforms, subsea wellheads or any other well location. Aspects of the disclosure may also be practiced in connection with a coiled tubing production system, e.g., for producing hydrocarbons from the wellbore 12.

The well system 10 has a coiled tubing system 11, which generally utilizes a coiled tubing string 18, e.g., to conduct various drilling and production operations. As used herein, the term "coiled tubing string" will include any pipe string that may be wound on a spool or otherwise deployed rapidly including continuous metal tubulars such as low-alloy carbon-steel tubulars, composite coiled tubulars, capillary tubulars and the like. Coiled tubing string 18 is characterized by an uphole end 18*a*, a downhole end 18*b*, and includes an inner annulus or flowbore 19 extending therebetween. The coiled tubing string 18 is stored on a spool or reel 20 (e.g., by being wrapped about the reel 20) positioned adjacent a wellhead 21. A tube guide 22 guides the coiled tubing string 18 into an injector 24 positioned above wellhead 21, and is used to feed and direct the coiled tubing string 18 into and out of the wellbore 12. The injector 24 may be suspended by a conventional derrick (not shown) or, as in the present example, a crane 25.

The coiled tubing string 18 extends through a blowout preventer ("BOP") stack 26 connected to a wellhead 21 for pressure control of wellbore 12. Positioned atop the BOP stack 26 is a lubricator mechanism or stuffing box 27 which provides the primary operational seal about the outer diameter of the coiled tubing string 18 for the retention of any pressure that may be present at or near the surface of the wellbore 12.

A working or service fluid source 48, such as a storage tank or vessel, may supply a working fluid 50 to coiled tubing string 18. In particular, fluid source 48 is in fluid communication with a high pressure fluid swivel 52 secured to reel 20 and in fluid communication with the interior of coiled tubing string 18. Working fluid source 48 may supply any fluid utilized in coiled tubing operations, including without limitation, drilling fluid, cementitious slurry, acidizing fluid, liquid water, steam or some other type of fluid. Various examples of fluids that may be provided by fluid source 48 and employed in the drilling and production operation described herein include air, water, oil, lubricant, friction reducer, natural gas, mist, foam, surfactant, nitrogen, various gases, drilling mud, acid, etc., or any combination thereof, which are flowed through the coiled tubing string 18 during a downhole operation. The coiled tubing system 11 may also include a power supply 54 and a command station 56 for controlling the coiled tubing operations.

Coiled tubing system 11 may be used in this example for servicing a pipe system 58. For purposes of this disclosure, pipe system 58 may include casing, risers, tubing, drill strings, completion or production strings, subs, heads or any other pipes, tubes or equipment that couples or attaches to the foregoing, such as collars, cleaning tools 60 and joints, as well as the wellbore 12 itself and laterals in which the pipes, casing and strings may be deployed. In this regard, pipe system 58 may include one or more casing strings 62, which may be cemented in wellbore 12, such as the surface, intermediate and production casing strings 62 shown in FIG. 1. An annulus 64 is formed between the walls of sets of adjacent tubular components, such as concentric casing strings 62 or the exterior of coiled tubing string 18 and the inside wall 66 of wellbore 12, a horizontal deviation 67 of the wellbore 12 or casing string 62, as the case may be.

A wireline tool carrier 68 or a series of wireline tool carriers 68 may be coupled to the downhole end 18*b* of the coiled tubing string 18. Disposed downhole of the wireline tool carrier(s) 68 may be bottom hole equipment 69, which may include fluid-activated components such as motors, valves, etc. The bottom hole equipment 69 may include fluid-activated components carried by the coiled tubing string 18 and coupled below the tool carriers 68, and/or components disposed in the wellbore 12 independently of the coiled tubing string 18 and tool carriers 68. Any fluid-activated components in the bottom hole equipment 69 may be activated by fluid from fluid source 48 that flows through the wireline tool carriers 68.

An upper wire 59*a* runs from the reel 20 located at the surface 16, through the coiled tubing string 18, and may be electrically coupled to the wireline tool carrier 68. The upper wire 59*a* may include electric conductors and/or fiber optic cables, and operably couples the wireline tool carrier 68 to the command station 56. The upper wire 59*a* may be used for telemetry communication of downhole formation 14 or wellbore 12 parameters and as a conduit for electric power for a wireline tool 90 (FIG. 2) carried by the wireline tool carrier 68.

Figure 2:
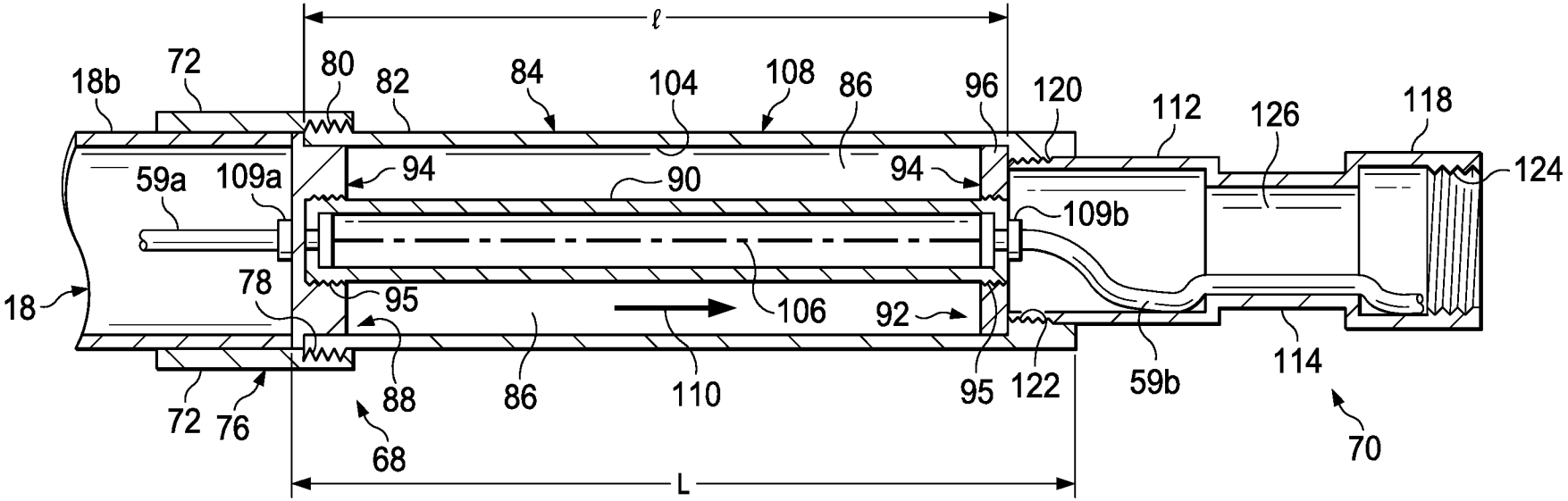
FIG. 2 is an enlarged elevation view in partial cross section of the wireline tool carrier of FIG. 1, illustrating a fixed stabilizer and a floating stabilizer for supporting a wireline tool within a tubular member.

Turning now to FIG. 2, an enlarged elevation view in partial cross section is presented of the wireline tool carrier 68 and a flexible joint 70 coupled thereto. The flexible joint 70 facilitates a mechanical and/or electrical connection of the wireline tool carrier 68 to an additional wireline tool carrier 68, downhole equipment 69 (FIG. 1) and/or other components.

The wireline tool carrier 68 includes an elongated tubular member 84 coupled to the downhole end 18*b* of the coiled tubing string 18 by a connector 72. The connector 72 may be attached in a number of ways to the downhole end 18*b* of the coiled tubing string 18 including without limitation by crimping, threads or pinned connections. A downhole end 76 of the connector 72 includes female threads 78 for mating with male threads 80 located on an outer surface 82 of the elongated tubular member 84 of the wireline tool carrier 68. The connector 72 permits fluid communication between the downhole end 18*b* of the coiled tubing string 18 and the wireline tool carrier 68.

The tubular member 84 may be constructed of steel or similar metal such that the tubular member 84 is relatively rigid as compared to the coiled tubing string 18. Alternatively, the tubular member 84 may be generally flexible. The tubular member 84 defines an internal passageway 86, which may have the same inside diameter of the coiled tubing string 18. Disposed within the internal passageway 86 are a fixed stabilizer 88, a wireline tool 90 and a floating stabilizer 92. The wireline tool 90 may be any number of tools used in wellbore 12 operations, such as, but not limited to, production logging, cement bond inspection, caliper, and pressure tools.

Each stabilizer 88, 92 is secured to the wireline tool 90 and radially spaces the wireline tool 90 from the inner surface 104 of the elongated tubular member 84. In the illustrated embodiment, each stabilizer 88, 92 includes a coupler 94 having a threaded aperture 95 for receiving an end of the wireline tool 90 therein, and at least one radial member 96 extending between the coupler 94 and the inner surface 104 of the tubular member 84. In other embodiments (not shown), the coupler 94 may include any structure that secures or otherwise attaches the one or more of the radial members 96 to the wireline tool 90. For example, the coupler 94 may include a threaded fastener, clamp, cotter pin, etc. supported by an individual radial member 96, such that any number of radial members 96 may be individually secured to the wireline tool 90 at circumferentially spaced locations.

Referring again to the embodiments illustrated in FIG. 2, each stabilizer 88, 92 includes at least one radial member 96 that radially extends from an outer surface 98 of the coupler 94. The fixed stabilizer 88 may contain a plurality of radial members 96 that are fixedly attached to the inner surface 104 of the tubular member 84. The radial members 96 of the fixed stabilizer 88 may be attached to the inner surface 104 of the tubular member 84 in a number of ways, including but not limited to by welding, fasteners or threads. This configuration prevents the wireline tool 90 from being axially displaced within the tubular member 84. Axial displacement of the wireline tool 90 may otherwise occur due to gravitational forces and/or due to external forces applied on the wireline tool 90 and stabilizers 88, 92 from the presence of fluid flowing through the internal passageway. This configuration also prevents axial motion between the fixed stabilizer 88 and the floating stabilizer 92 when both of the stabilizers 88, 92 are coupled to the wireline tool 90. The fixed stabilizer 88 may be positioned at any place along the longitudinal axis 106 of the tubular member 84.

The floating stabilizer 92 has radial members 96 that radially extend towards, but are not fixedly connected to, the inner surface 104 of the tubular member 84. The radial members 96 of the floating stabilizer 92 are unattached from the tubular member 84 and facilitate the installation of the wireline tool 90 within the tubular member 84. For example, in one embodiment, the floating stabilizer 92 may first be secured to the wireline tool 90, and the wireline tool 90 and floating stabilizer 92 may both be inserted together into the tubular member 84. Since the floating stabilizer 92 is not fixed to the tubular member 84, the wireline tool 90 may be manipulated into position and secured to the fixed stabilizer 88 within the tubular member 84. Similar to the fixed stabilizer 88, the floating stabilizer 92 may be positioned at any place along the longitudinal axis 106 of the tubular member 84.

The overall length "L" of the tubular member 84 may be greater than the length of the wireline tool 90 "l". The wireline tool 90 may thus be fully housed within the tubular member 84 and will not interfere with other equipment coupled to the downhole end 108 of the tubular member 84. Thus, a variety of other equipment, e.g., an additional wireline tool carrier 68, a flexible joint 70, or other bottom hole equipment 69 may be selected for coupling to the downhole end 108 of the wireline tool carrier 68 to suit the particular needs of a well system 10.

As previously mentioned, upper wire 59*a* is run from the reel 20 located at the surface 16 through the coiled tubing string 18, and is electrically coupled to the wireline tool 90 through a first terminal 109*a*. The first terminal 109*a* may be disposed on the fixed stabilizer 88 or may be a component of the wireline tool 90. Similarly, a second terminal 109*b* may be disposed on the floating stabilizer or may also be a component of the wireline tool 90.

Although not shown, the tubular member 84 may contain multiple fixed stabilizers 88 and floating stabilizers 92 positioned along the longitudinal axis 106 of the tubular member 84. Alternatively, only a single stabilizer, e.g., the fixed stabilizer 88, may be positioned along the longitudinal axis 106 of the tubular member 84 as opposed to both the fixed stabilizer 88 and the floating stabilizer 92.

A longitudinal flow path 110 extends from the coiled tubing string 18 through the elongate tubular member 84. Within the tubular member 84, the longitudinal flow path 110 is defined between the inner surface 104 of the tubular member 84, the radial members 96 of the fixed stabilizer 88 and around the wireline tool 90 when the wireline tool 90 is selectively coupled to the at least one radial member 96. The flow path 110 facilitates fluid communication between the coiled tubing string 18, wireline tool carrier 68, bottom hole equipment 69 and the wellbore 12 while the wireline tool 90 is deployed within the wellbore 12. Fluid may be conveyed either downhole or uphole around the wireline tool 90 through the flow path 110. As described further herein, fluid flowing downhole through the flow path 110 may be used to complete a number of operation and maintenance objectives in the wellbore 12.

The flexible joint 70 may be coupled to the downhole end 108 of the wireline tool carrier 68 to facilitate relative angular movement between the wireline tool carrier 68 and any other equipment (not shown) coupled to the flexible joint. The flexible joint 70 includes a first end 112, a deviation section 114, and a second end 118. The first end 112 of the flexible joint 70 is provided with male threads 120 for mating with the female threads 122 of the tubular member 84 of the wireline tool carrier 68 or alternatively another flexible joint. Additionally, the second end 118 of the flexible joint 70 is provided with female threads 124 that may be used to connect other equipment (not shown) such as the tubular member of another wireline tool carrier or another flexible joint. It should be appreciated the flexible joint 70 may be attached in a number of alternate ways to the downhole end 108 of the wireline tool carrier 68 or other joints. The deviation section 114 of the flexible joint 70 comprises a mechanism that allows the flexible joint 70 to bend or pivot. In certain illustrative embodiments this mechanism may be a hinge or a ball and socket apparatus or some other mechanism that allows deflection or bending between the first end 112 and second end 118 of the flexible joint 70. Although depicted at the downhole end 108 of the wireline tool carrier 68 in FIG. 2, in other embodiments, the flexible joint 70 may be disposed between any components coupled to the downhole end 18*b* of the coiled tubing string 18, and may be used to navigate deviations 67 encountered by the wireline tool carrier 68 and bottom hole equipment 69 in the wellbore 12. A series of flexible joints 70 may be used to incrementally increase the angle of deviation of the coiled tubing string 18, wireline carrier tool 68 and bottom hole equipment 69 upon encountering a deviated hole 67 with a sharp bending radius as each is deployed downhole in the wellbore 12.

An internal passageway 126 extends through the first end 112, deviation section 114 and second end 118 of the flexible joint 70. Similar to the flow path 110 of the wireline tool carrier 68, the internal passageway 126 of the flexible joint 70 allows fluid communication through the flexible joint 70. The internal passageway 126 houses a lower wire 59*b*, which may extend from the wireline tool carrier 68 or another flexible joint. The lower wire 59*b* permits the wireline tool 90 to be electronically coupled to elements of bottom hole equipment 69 located within the wellbore 12. Disposing the lower wire 59*b* within the internal passageway 126 of the flexible joint 70 protects it from constant exposure to the wellbore 12 environment.

Figure 3B:
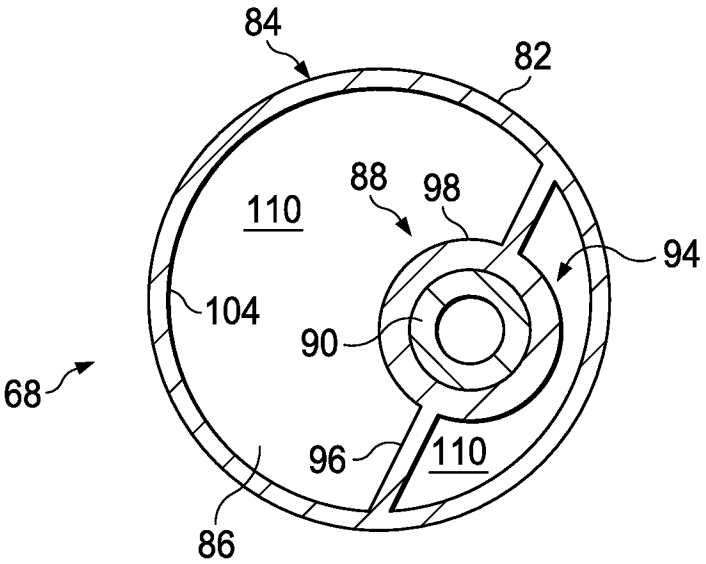
FIG. 3B is a longitudinally cross-sectional view of an alternate example wireline tool carrier taken near a fixed stabilizer supporting the wireline tool in an eccentric location in the tubular member.
Figure 3A:
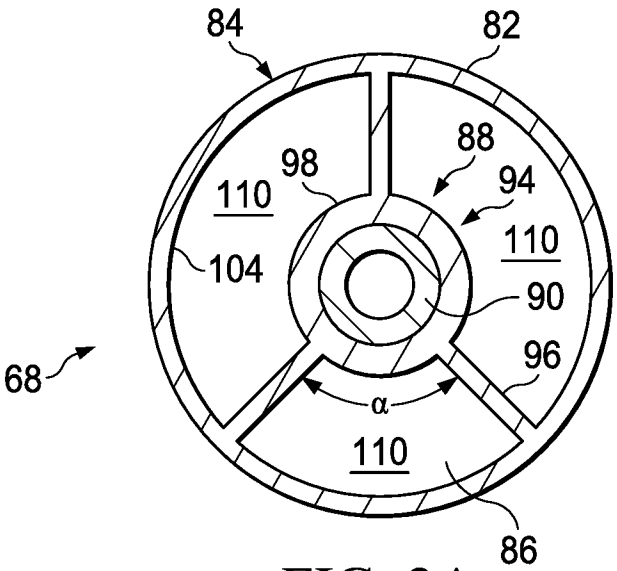
FIG. 3A is a longitudinally cross-sectional view of the wireline tool carrier taken near the fixed stabilizer illustrating the wireline tool supporting in a central location in the tubular member.

FIG. 3A illustrates an enlarged cross sectional view of the wireline tool carrier 68 taken near the fixed stabilizer 88 along the longitudinal axis 106 of the tubular member 84. Three stabilizer radial members 96 are positioned at obtuse angles "a" from one another. In other embodiments, fewer or more radial members 96 may be positioned at various angles "a" from one another. Additionally, in other embodiments (not shown) the radial member(s) 96 may be a perforated disc or take on the shape of any other polygon or ellipse, which radially spaces the wireline tool 90 from the inner surface 104 of the tubular member 84. The flow path 110 is defined between the at least one radial member 96. FIG. 3A also depicts the wireline tool 90 as being positioned coaxially with the tubular member 84. However, as illustrated in FIG. 3B, in other embodiments, the wireline tool 90 may be placed eccentrically or off-center with respect to the longitudinal axis 106 of the tubular member 84. FIGS. 3A and 3B depict the coupler 94 in a circular fashion. However, the coupler 94 may take on the shape of any polygon to accommodate a corresponding alternate shape of the wireline tool 90. Further, the coupler 94 may be configured to hold multiple wireline tools 90 within the tubular member 84. For instance, a series of wireline tools 90 may be held in an end to end orientation or in a vertical and/or horizontal array (e.g. in a bundle) within the tubular member 84.

Figure 4:
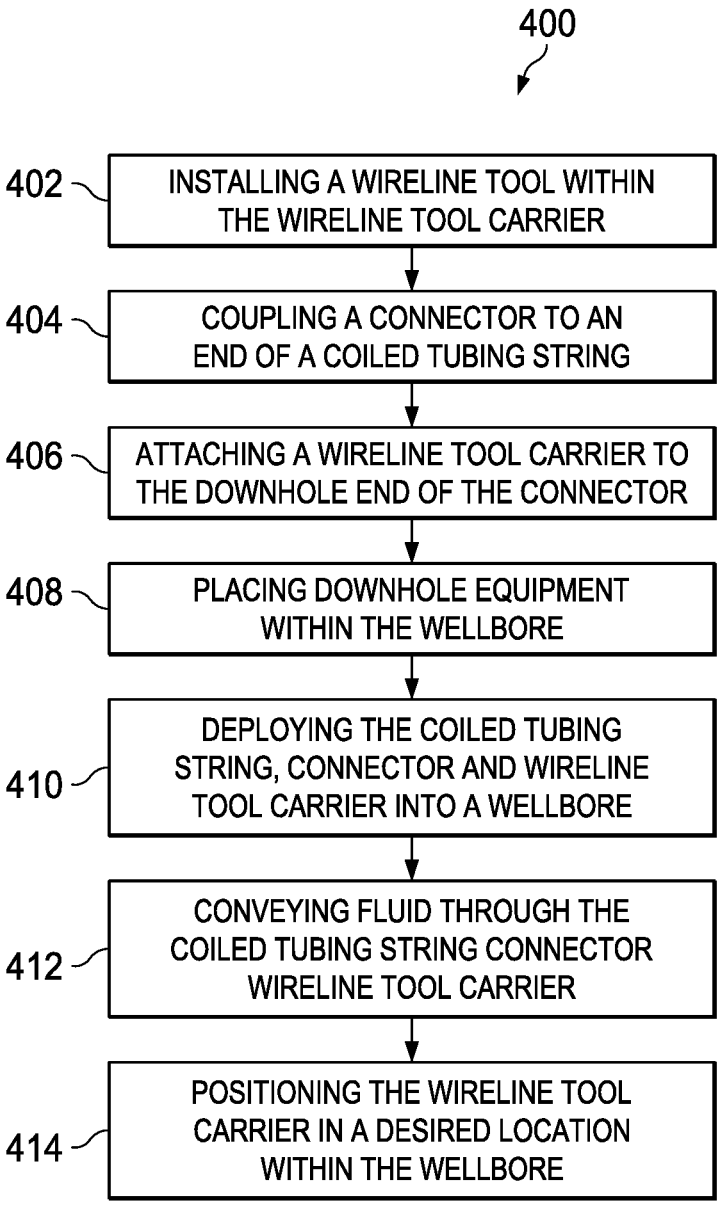
FIG. 4 is a flowchart depicting a method for using coiled tubing to position a wireline tool within a wellbore, according to certain illustrative embodiments of the present disclosure.

With reference to FIG. 4, an operational procedure 400 for use of the above described systems is discussed. In step 402 a wireline tool 90 is installed within a wireline tool carrier 68. The wireline tool carrier 68 may be selected from an inventory of tool carriers such that the overall length "L" of the tool carrier accommodates the length "l" of the wireline tool 90. In one illustrative embodiment the floating stabilizer 92 is first removed from the internal passageway 86 of the tubular member 84. The wireline tool 90 may then be inserted into the internal passageway 86, and an end of the wireline tool 90 is secured into the coupler 94*a* of the fixed stabilizer 88. The floating stabilizer 92 may then be replaced into the wireline tool carrier 68 tubular member 84, and the coupler 94 of the floating stabilizer 92 may then be threaded onto the wireline tool 90 to support an end of the wireline tool 90 opposite the fixed stabilizer 88.

In step 404 a connector 72 is coupled to the downhole end 18*b* of a coiled tubing string 18. The connector 72 may be crimped to the downhole end 18*b* of the coiled tubing string 18. The connector 72 may be crimped such that the female threads 78 extend beyond the downhole end 18*b* of the coiled tubing string 18. Although step 404 is illustrated as being performed subsequent to step 402, it should be appreciated that step 404 may also be performed prior to step 402 and/or concurrently with step 402.

In step 406 the wireline tool carrier 68 is attached to the downhole end 18*b* of the coiled tubing string 18. Prior to mating the tool carrier 68 and the connector 72, the upper wire 59*a* is connected to the terminal 109*a* or the fixed stabilizer 88. The wireline tool carrier 68 may be secured to the downhole end 76 of the connector 72 by engaging male threads 80 of the tubular member 84 with the female threads 78 on the downhole end 76 of the connector 72.

In step 408, depending on the geometry of the wellbore 12, one or more flexible joints 70 may be secured to the wireline tool carrier 68. Additionally, based on the scope of the wellbore operation a number of additional wireline tool carriers 68 or bottom hole equipment 69 may be fastened to the downhole end 108 of the wireline tool carrier 68.

In step 410 the coiled tubing string 18, the wireline tool carrier 68, the flexible joint(s) 70 and the bottom hole equipment 69 are deployed in the wellbore 12. Next, at step 412, fluid, e.g., from fluid source 48, is conveyed through the coiled tubing string 18 and the wireline tool carrier 68. For example, fluid may be conveyed in a downhole direction through the flow path 110 within the tubular member 84 around the wireline tool 90. The fluid may then be expelled through nozzles (not shown) on the cleaning tool 60 to clear debris as the coiled tubing string 18 is advanced in the wellbore 12. Thus, the need for multiple runs to deploy the wireline tool 90 is eliminated and a multitude of well intervention operations are enabled as the wireline tool carrier 68 is deployed in the wellbore 12. The internal passageway 86 of the wireline tool carrier 68 allows these runs to be consolidated into one trip. Additionally, fluid flowing downhole through the wireline tool carrier 68 may also be used to inject chemicals into the formation 14 for stimulation or to actuate downhole equipment 69. Alternatively, fluid may flow uphole through the wireline tool carrier 68 in a debris cleaning operation where fluid is first flowed down the wellbore annulus 64 and then up through the wireline tool carrier 68 and coiled tubing string 18.

In step 414, the wireline tool carrier 68 is positioned in a desired location within the wellbore 12. In some embodiments, step 414 is conducted concurrently with step 412. When the wireline tool 90 is positioned at the desired location within the wellbore 12, the wireline tool 90 may begin logging a host of formation 14 and wellbore 12 parameters. These parameters may be communicated to the command station 56 through the upper wire 59*a* or stored in a memory carried by the wireline tool 90. Additionally or alternatively, the wireline tool 90 may communicate data or instructions with intelligent completion assemblies (not shown) located in the wellbore 12. In one embodiment, once the wireline tool carrier 68 is positioned at a desired location within the wellbore 12, fluid may flow uphole through the wireline tool carrier 68 during a production logging operation. For example, a designated portion of the wellbore 12 may be isolated using a packer assembly (not shown), and then the wireline tool 90 may be used to log the characteristics of the produced fluid from the designated zone as it travels uphole through the wireline tool carrier 68. Both the clean-out and logging operations may continue as the wireline tool 90 is advanced downhole beyond the desired location. The coiled tubing string 18 provides the wireline tool 90 with sufficient stiffness to permit the wireline tool 90 to be maneuvered into a deviated section 67 of the wellbore 12. Additionally, a flexible joint 70 or a series of flexible joints 70 may assist in navigating these areas.

Thus a wireline tool carrier system for using coiled tubing to position a wireline tool within a wellbore in a single run has been described. Embodiments of the wireline tool carrier system may generally include a coiled tubing string; an elongate tubular member coupled to an end of the coiled tubing string and having an inner surface an outer surface, and an internal passageway extending there through; a first stabilizer disposed within the tubular having at least one radial member connected to the inner surface of the tubular; a connector coupled to a downhole end of the coiled tubing string and an uphole end of the tubular member; and a longitudinal fluid flow path formed between the coiled tubing string and the inner passageway of the tubular member.

Similarly a method for using coiled tubing to position a wireline tool within a wellbore in a single run has been described. Embodiments of the method may generally include securing the tool within an elongate tubular member of a tool carrier system to define a longitudinal flow path extending through an interior of the elongate tubular member between the tool and the elongate tubular member; coupling the elongate tubular member of the tool carrier system at a downhole end of a coiled tubing string; deploying the downhole end of the coiled tubing string and the tool carrier system in the wellbore; flowing fluid through the coiled tubing string and past the tool in the longitudinal flow path of the tool carrier system while the tool carrier system is deployed downhole; and advancing the coiled tubing string into the wellbore to position the tool carrier system at a desired location within the wellbore.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

For any of the foregoing embodiments, the wireline tool carrier may include any one of the following elements, alone or in combination with each other.

In one aspect the disclosure is directed to a coiled tubing system for carrying a wireline tool in a wellbore. The system includes a coiled tubing string. An elongate tubular member is coupled to an end of the coiled tubing string. The elongate tubular member has an inner surface, an outer surface, and an internal passageway extending therethrough. A first stabilizer is disposed within the internal passageway. The first stabilizer has a first at least one radial member for selectively coupling to the wireline tool and for spacing the wireline tool from the inner surface of the elongate tubular member. A longitudinal fluid flow path extends from the coiled tubing string through the elongate tubular member. The longitudinal flow path is defined between the inner surface of the elongate tubular member, the at least one radial member of the first stabilizer and the wireline tool when the wireline tool is selectively coupled to the at least one radial member.

The carrier system may include a second stabilizer selectively attachable to the wireline tool disposed within the internal passageway longitudinally spaced from the first stabilizer when the wireline tool is disposed within the internal passageway. The second stabilizer may have at least one radial member selectively coupled to the wireline tool, wherein the at least one radial member spaces the wireline tool from the inner surface of the elongate tubular member.

The at least one radial member of the first stabilizer may be fixedly attached to the inner surface of the elongate tubular member.

The at least one radial member of the second stabilizer may extend to the inner surface of the elongate tubular member but yet is unattached to the inner surface of the elongate tubular member.

The first stabilizer may include a first coupler for selectively receiving the wireline tool therein, wherein the at least one radial member extends between the coupler and the inner surface of the elongate tubular member.

The carrier system may include at least one upper wire extending through the coiled tubing string and coupled to the first stabilizer.

The upper wire may be at least one of the group consisting of a fiber optic cable and an electrical cable.

The carrier system may include a wireline tool communicatively coupled to the upper wire and selectively coupled to the at least one radial member.

The wireline tool may be coaxially disposed within the elongate tubular member.

The wireline tool may be eccentrically disposed within the elongate tubular member.

The carrier system may include at least one lower wire disposed within the internal passageway and operably coupled to bottom hole equipment coupled to a downhole end of the elongate tubular member.

The lower wire may be coupled to the wireline tool.

The lower wire may be coupled to the first stabilizer.

The carrier system may include a cleaning tool coupled to a downhole end of the elongate tubular member.

The carrier system may include a flexible joint coupled to an end of the elongate tubular member, the flexible joint having a first end a second end and a deviation section therebetween.

In another aspect, the disclosure is directed to a method for carrying a wireline tool within a wellbore. The method includes (a) securing the wireline tool within an elongate tubular member to define a longitudinal flow path extending through an interior of the elongate tubular member between the wireline tool and the elongate tubular member, (b) coupling the elongate tubular member to a downhole end of a coiled tubing string, (c) deploying the downhole end of the coiled tubing string, the elongate tubular member, and the wireline tool into the wellbore, (d) flowing fluid through the coiled tubing string and past the wireline tool through the longitudinal flow path while the tool is deployed in to the wellbore and (e) advancing the coiled tubing string into the wellbore to thereby position the wireline tool at a desired location within the wellbore.

Flowing fluid through the coiled tubing string and past the wireline tool through the longitudinal flow path while the tool is deployed in to the wellbore may further include discharging fluid into the wellbore through a cleaning tool. The method may further include carrying debris from the wellbore in the flowing fluid.

Securing the wireline tool within the elongate tubular may further comprise coupling the tool to at least one stabilizer extending radially between the wireline tool and an inner surface of the elongate tubular member.

Coupling the wireline tool to at least one stabilizer may further comprise securing the wireline tool to a stabilizer that has at least one radial member fixedly attached to the inner surface of the elongate tubular member.

Advancing the coiled tubing string into the wellbore to thereby position the wireline tool at a desired location within the wellbore may further comprise positioning the wireline tool in a deviated section of the wellbore.

Deploying the downhole end of the coiled tubing string, the elongate tubular member, and the wireline tool into the wellbore may further comprise collecting or transmitting wellbore or formation parameters while the wireline tool is deployed within the wellbore.

What is claimed is:

1. A coiled tubing system for carrying a wireline tool in a wellbore, the system comprising:

a coiled tubing string;

an elongate tubular member coupled to an end of the coiled tubing string, the elongate tubular member having an inner surface, an outer surface, and an internal passageway extending therethrough;

a first stabilizer disposed within the internal passageway, the first stabilizer having at least one radial member selectively attachable to the wireline tool, wherein the at least one radial member spaces the wireline tool from the inner surface of the elongate tubular member;

a longitudinal fluid flow path extending from the coiled tubing string through the elongate tubular member, a cross-section of the longitudinal flow path defined between the inner surface of the elongate tubular member and the at least one radial member of the first stabilizer; and a second stabilizer selectively attachable to the wireline tool to be longitudinally spaced from the first stabilizer when the wireline tool is disposed within the internal passageway, the second stabilizer having at least one radial member selectively attachable to the wireline tool, wherein the at least one radial member spaces the wireline tool from the inner surface of the elongate tubular member;

wherein the first stabilizer is fixedly attached to the inner surface of the elongate tubular member and the first stabilizer is uphole of the second stabilizer; and wherein the at least one radial member of the second stabilizer extends to the inner surface of the elongate tubular member and is not fixed to the inner surface of the elongate tubular member.

2. The carrier system of claim 1, wherein the at least one radial member is fixedly attached to the inner surface of the elongate tubular member.

3. The carrier system of claim 2, wherein the first stabilizer includes a first coupler having an aperture for selectively receiving an end of the wireline tool therein, and wherein the at least one radial member extends between the first coupler and the inner surface of the elongate tubular member.

4. The carrier system of claim 1, further comprising at least one upper wire extending through the coiled tubing string and coupled to the first stabilizer.

5. The carrier system of claim 4, wherein the upper wire comprises at least one of the groups consisting of a fiber optic cable and an electrical cable.

6. The carrier system of claim 4, wherein the upper wire comprises the fiber optic cable and the wireline tool is optically coupled to the upper wire and attached to the at least one radial member; and/or wherein the upper wire comprises the electrical cable and the wireline tool is electrically coupled to the upper wire and attached to the at least one radial member.

7. The carrier system of claim 6, wherein the wireline tool is coaxially disposed within the elongate tubular member.

8. The carrier system of claim 6, wherein the wireline tool is not coaxially disposed within the elongate tubular member.

9. The carrier system of claim 6, further comprising at least one lower wire disposed within the internal passageway and operably coupled to bottom hole equipment coupled to a downhole end of the elongate tubular member.

10. The carrier system of claim 9, wherein the at least one lower wire is coupled to the wireline tool.

11. The carrier system of claim 1, further comprising a flexible joint coupled to an end of the elongate tubular member, the flexible joint having a first end, a second end, and a deviation section therebetween.

12. A method for carrying a wireline tool within a wellbore, the method comprising:

securing the wireline tool within an elongate tubular member by coupling the wireline tool to a first stabilizer that is fixedly attached to an inner surface of the elongate tubular member and to at least one radial member of a second stabilizer that is selectively attachable to the wireline tool;

wherein the at least one radial member spaces the wireline tool from the inner surface of the elongate tubular member;

wherein the first stabilizer is uphole of the second stabilizer;

wherein the at least one radial member extends to the inner surface of the elongate tubular member and is not fixed to the inner surface of the elongate tubular member; and wherein a longitudinal flow path extends through an interior of the elongate tubular member between the wireline tool and the elongate tubular member, a cross-section of the longitudinal flow path being defined between the inner surface of the elongate tubular member and the first and second stabilizers;

coupling the elongate tubular member to a downhole end of a coiled tubing string;

deploying the downhole end of the coiled tubing string, the elongate tubular member, and the wireline tool into the wellbore;

flowing fluid through the coiled tubing string and past the wireline tool through the longitudinal flow path while the tool is deployed in to the wellbore; and advancing the coiled tubing string into the wellbore to thereby position the wireline tool at a desired location within the wellbore.

13. The method of claim 12, further comprising positioning the wireline tool in a deviated section of the wellbore.

14. The method of claim 12, further comprising collecting or transmitting wellbore or formation parameters while the tool is deployed within the wellbore.

* * * * *